US008151494B2

(12) United States Patent
Scheib et al.

(10) Patent No.: US 8,151,494 B2
(45) Date of Patent: Apr. 10, 2012

(54) COUPLER

(75) Inventors: Michael Kevin Scheib, Auckland (NZ); Timothy Craig Balemi, Auckland (NZ)

(73) Assignee: S T Couplers Limited, Auckland (NZ)

( * ) Notice: Subject to any disclaimer, the term of this patent is extended or adjusted under 35 U.S.C. 154(b) by 132 days.

(21) Appl. No.: 12/311,832

(22) PCT Filed: Oct. 24, 2007

(86) PCT No.: PCT/NZ2007/000320

§ 371 (c)(1), (2), (4) Date: Apr. 15, 2009

(87) PCT Pub. No.: WO2008/051095

PCT Pub. Date: May 2, 2008

(65) Prior Publication Data

US 2010/0275474 A1 Nov. 4, 2010

(30) Foreign Application Priority Data

Oct. 26, 2006 (NZ) ..... 550869

(51) Int. Cl.
*E02F 3/96* (2006.01)

(52) U.S. Cl. ..... 37/468

(58) Field of Classification Search ..... 37/468, 37/403, 444; 414/723, 724; 172/272, 273, 172/275; 403/321, 322.1
See application file for complete search history.

(56) References Cited

U.S. PATENT DOCUMENTS

| | | | | | |
|---|---|---|---|---|---|
| 4,881,867 | A | * | 11/1989 | Essex et al. | 414/723 |
| 5,082,389 | A | | 1/1992 | Balemi | |
| 5,456,030 | A | * | 10/1995 | Barone et al. | 37/468 |
| 5,692,325 | A | * | 12/1997 | Kuzutani | 37/468 |
| 6,058,633 | A | * | 5/2000 | Barden | 37/468 |
| 6,132,131 | A | * | 10/2000 | Nakamura et al. | 403/322.1 |
| 6,233,852 | B1 | * | 5/2001 | Pemberton | 37/468 |

(Continued)

FOREIGN PATENT DOCUMENTS

AU 18602/83 3/1984

(Continued)

OTHER PUBLICATIONS

CJM Shotgun Autolock Brochure.

(Continued)

*Primary Examiner* — Robert Pezzuto
(74) *Attorney, Agent, or Firm* — Jacobson Holman PLLC

(57) ABSTRACT

A coupler assembly to interpose between the arm of the vehicle and a parallel pinned implement having two docks, one on each of the two members able to be caused to slide relative to each other, each dock engagable outwardly to its pin with at least one pin being captive in its dock by a pivoted retention member.

30 Claims, 14 Drawing Sheets

U.S. PATENT DOCUMENTS

| | | | | |
|---|---|---|---|---|
| 6,379,075 | B1 * | 4/2002 | Shamblin et al. | 403/322.1 |
| D458,942 | S | 6/2002 | Balemi | |
| 6,431,785 | B1 * | 8/2002 | Melander | 403/322.1 |
| 6,691,438 | B2 | 2/2004 | Fatemi | |
| 6,902,346 | B2 | 6/2005 | Steig, Jr. et al. | |
| 6,962,475 | B2 | 11/2005 | Fatemi | |
| 6,964,122 | B2 * | 11/2005 | Cunningham et al. | 37/468 |
| 7,032,335 | B2 * | 4/2006 | Short | 37/468 |
| 7,306,395 | B2 * | 12/2007 | Fatemi | 403/321 |
| 7,426,796 | B2 * | 9/2008 | Cunningham et al. | 37/468 |
| 7,473,067 | B2 * | 1/2009 | Nishioka et al. | 414/723 |
| 7,493,712 | B2 * | 2/2009 | McCormick et al. | 37/468 |
| 7,594,776 | B2 * | 9/2009 | Steig et al. | 403/322.3 |
| 7,648,305 | B2 * | 1/2010 | Beales | 403/322.1 |
| 7,744,301 | B2 * | 6/2010 | Fatemi | 403/322.1 |
| 7,797,862 | B2 * | 9/2010 | Daraie et al. | 37/468 |
| 2005/0214105 | A1 | 9/2005 | Steig, Jr. et al. | |
| 2010/0107456 | A1 | 5/2010 | Miller | |

FOREIGN PATENT DOCUMENTS

| | | |
|---|---|---|
| EP | 1 637 659 | 3/2006 |
| GB | 2 330 569 | 4/1999 |
| GB | 2 330 570 | 4/1999 |
| GB | 2332417 | 6/1999 |
| WO | WO 88/02421 | 4/1988 |
| WO | WO 00/70155 | 11/2000 |
| WO | WO 2006/083172 | 8/2006 |

OTHER PUBLICATIONS

International Search Report dated Mar. 28, 2008.

* cited by examiner

COUPLER

This is a national stage of PCT/NZ07/000,320 filed Oct. 24, 2007 and published in English, which has a priority of New Zealand no. 550869 filed Oct. 26, 2006, hereby incorporated by reference.

The present invention relates to a coupler suitable for coupling between a boom or arm and any appropriate implement.

Couplers for such usage have been sold by us and/or our affiliates as the QUICK-HITCH™ throughout the world. Early versions of such a product were typified by U.S. Pat. No. 5,082,389 (William J Balemi). It involves a dock to receive a machine or implement pin from one direction and a dock opening into which the other pin can be positioned from another (and not opposite) direction prior to being locked into position.

Later variants of such couplers include that of U.S. Design Pat. 458942 (Stephen J Balemi).

Other variations include articulating forms of such couplers.

Various other forms of coupler exist in the art and in the marketplace. Many of these include similar orthogonally open docking arrangements as in U.S. Pat. No. 5,082,389 and U.S. Design Pat. 458,942. Others however have other arrangements.

U.S. Pat. No. 6,902,346 (Hendricks Manufacturing Limited) has one docking arrangement on a pivoted arm that is moveable under the action of double acting ram against a stop. Similarly UK Patent Application GB2330570 of Miller et al.

Nevertheless, we believe there is a need for an alternative coupler to those disclosed.

Any such form should be easy to operate and be safe to use. That is an object of the invention.

The coupler preferably is of a kind permanently or semi permanently pivoted about an axis of the boom that is parallel to one or more horizontal rotational axis (or axes) in the boom itself. The coupler is to serve the function of being able to engage at will with appropriate docking features (hereafter "pins" irrespective of the form thereof) of attachable apparatus ("implement(s)") under the action of a controller of the boom and any control functions thereof and its carrying of the coupler.

We favour oppositely open docks for engaging the implement pins with at least one being locked to cover the case of any hydraulic failure, and if one, or an alternative, object of the invention.

It is an alternative or another object of the present invention to provide a coupler (preferably a hydraulic coupler) able to be readily engaged first to one pin and then to another pin, there being provision whereby, even with failure of hydraulic systems, there is a safety retention of at least one pin in a docking of the housing.

It is a further or alternative object of the present invention to provide such a coupler, an arm or boom embodying such a coupler, a combination of an appropriate implement dockable with such a coupler and the coupler or the coupler and the boom, and related assemblies, subassemblies, procedures of use and the like, which will at least provide the public with a useful choice insofar as coupling is concerned.

In a first aspect the invention consists in a coupler assembly of or for a boom or arm and connectable to a double pinned implement, the coupler assembly having a first component or assembly ("first component"), the first component having a dock into which a first pin is to be received transversely of its pin axis, a slide or second component ("slide") slideably mounted by said first component, the slide having a dock into which a second pin is to be received transversely of its pin axis, an actuator remotely or manually actuable to control the position of the slide relative to the first component, and a pivoted retention member pivoted from the first component and deployed or deployable as a retention member for a said first pin in the dock of the first component when the slide is not actuated to a position beyond that it assumes when docking and holding docked a second pin in the dock of the slide.

Preferably the pin axes and pivot axis are parallel when retaining docked pins.

Preferably the docks open to opposite directions.

Preferably the slide moves at least substantially parallel to those directions.

Preferably the actuator is a double acting hydraulic ram.

In another aspect the invention consists in a coupler assembly of or for a boom or arm and connectable to a double pinned implement, the coupler assembly having a first component or assembly ("first component"), the first component having a dock into which a first pin is to be received transversely of its pin axis from a first direction, a slide or second component ("slide") slideably mounted by said first component, the slide having a dock into which a second pin is to be received transversely of its pin axis from a second direction which is opposite to said first direction, an actuator remotely or manually actuable to control the position of the slide relative to the first component, and a retention member moveably supported (e.g. preferably pivoted) from the first component and deployed or deployable as a retention member for a said first pin in the dock of the first component.

Preferably the slide moves at least substantially parallel to the first and second directions.

In another aspect the invention consists in a coupler assembly of or for a boom or arm and connectable to a double pinned implement, the coupler assembly having a first component or assembly ("first component"), the first component having a dock into which a first pin is to be received transversely of its pin axis from a first direction, a slide or second component ("slide") slideably mounted by said first component, the slide having a dock into which a second pin is to be received transversely of its pin axis from a second direction opposite the first direction, an actuator remotely or manually actuable to control the position of the slide relative to the first component, and a pivoted retention member pivoted from the first component and deployed or deployable as a retention member for a said first pin in the dock of the first component, wherein the slide interacts with the pivoted retention member either to allow or cause its deployment or to allow or cause its withdrawal from deployment, or both.

The present invention consists in, in combination, a coupler assembly of any of the kinds previously defined and a boom or arm to which it is connected. Preferably said combination allows orientation of the coupler assembly relative to a pivot connection thereof with at least one part of the boom or arm.

Preferably said combination also includes an implement associable or associated with the coupler assembly.

In a further aspect the present invention consists in the use of apparatus in accordance with the present invention.

In yet a further aspect the present invention consists in a method of coupling and decoupling an implement from a boom or arm carried coupler assembly in accordance with any aspect of the present invention, said method involving engaging first one pin of the implement into a dock of the coupler and thereafter engaging the other pin into the other dock of the coupler. Preferably the act of engaging both pins has leads to the inevitable deployment of the pivoted retention member.

Preferably the release of the second pin from the second dock and extension of the slide thereafter leads to the undeployment or raising of the retention member.

As used herein the term "and/or" means "and" or "or", or both.

As used herein the term "(s)" following a noun includes, as might be appropriate, the singular or plural forms of that noun.

As used herein the term "pin" or variations thereof in respect of an implement includes any structure (whether round in section, or not, and whether supported at both ends, or not, by the implement) which is receivable in a dock of a complementary coupler.

As used herein the term "dock" refers to any recess or other like arrangement adapted to provide part of the support and/or location of a pin of an implement when docked therein.

As used herein "implement" includes those forms of apparatus previously mentioned and also any other apparatus that might merit attachment to and/or detachment from a machine boom or arm. Examples include but are not limited to buckets, scoops, vibrators, picks, grapples, etc.

A preferred form of the present invention will now be described with reference to the accompany drawings in which FIG. 1 shows a coupler in accordance with a first embodiment of the present invention pivot supported from the end of a boom and able to be rotated about that pivot under the action of a hydraulic ram acting on another pivot axis of the coupler, the coupler being shown in two distinct docks docked pins of an appropriate implement (in this case a bucket), FIG. 2 is a perspective view from above of a coupler in accordance with the present invention showing connectors to a double acting hydraulic cylinder, the ram of which is to actuate the slide, FIG. 3 is a similar view to that of FIG. 2 but this time showing the main components exploded therefrom, FIG. 4 is another exploded view but this time from the underside of the coupler, FIG. 5 is a plan view of the coupler of FIG. 2 from above, FIG. 6 is a side elevation of the coupler of FIG. 5, FIG. 7 shows a sectional view of a coupler of FIG. 6 but with the safety pivoted retention member raised, FIG. 8 is a similar view to that of FIG. 7 but showing the safety pivoted retention member lowered, FIG. 9A through 9D show in section in a manner similar to the view as in FIGS. 7 and 8 a progression from FIG. 9A (the safety pivoted retention member raised and the second dock at its greatest position to the left), FIG. 9B the safety pivoted retention member lowered as the slide under the action of the ram moves to the right, FIG. 9C the safety pivoted retention member still lowered whilst the second dock is at its furthest position from the left, and FIG. 9D shows a return of the slide under the action of the ram in the arrowed direction to the left as would be the case after a pin has been received in the first dock, such movement continuing only so far to the left as is warranted to have the second dock engage the second pin of the implement, FIG. 10 is a similar view to that of FIG. 9D but on a different sectional axis, FIG. 11 is a similar view to that of FIG. 10 but with the slide in a different disposition relative to the safety pivoted retention member, FIG. 12 is a view of a coupler as previously disclosed but having a lifting loop, FIG. 13 is the coupler of FIG. 12 from a different direction, FIG. 14 is the coupler of FIGS. 12 and 13 from still a different direction, FIG. 15 is an isometric view of a second embodiment of the present invention but which nonetheless is operable insofar as locking and sliding is concerned as for the first embodiment, the second embodiment showing a different form of lead in tongue of the first component for assembly, FIG. 16 is a plan view of the coupler of FIG. 15, FIG. 17 is a side elevation of the coupler of FIGS. 15 and 16, FIG. 18 is a view in elevation looking towards the tongue of the coupler of FIG. 15 to 17.

All main components of the preferred form of the present invention are formed from steel although parts of the hydraulic arrangement can be of any suitable materials and of course is adapted to be associated with pressure hose. Similarly pivot providing pins and the like can be of a suitable steel.

The components can be fabricated or cast or a mixture of both. They can be cast and be subjected to further machining.

A preferred form of the present invention will now be described. In the preferred form of the present invention the safety retention member is a pivoted member pivoted from the first component. In other arrangements an alternative to such a pivot arrangement can be some toggle or other preproducibly controllable attachment or association.

In the preferred form of the present invention it is also featured that the retention member can be deployed or is deployed (or both) when the slide is not actuated to a position beyond that which it assumes when docking and holding a second pin on the dock of the slide i.e. it is envisaged that movement of the slide has a capability of raising the pivoted retention member so that the first dock (i.e. that of the first component) can be used to receive and dock a pin of an implement whereupon movement of the slide to allow its positioning ready to have its dock receive the other pin allows the pivoted retention member to fall to a safety retention condition for the pin in the first dock.

In the preferred form of the present invention, the boom 1 pivots the coupler 2 on a pivot at 3. A hydraulic ram arrangement 4 of the boom acting through a set off pivot 5 and a linkage 6 acts on the pivot axis 7 (being the other pivot axis of the connector for association with the boom or parts of the boom).

An implement 8 (in this case a bucket) is docked reliant on a first pin 9 received in the first dock and a second pin 10 received in the second dock i.e. that of the slide 15. The first dock 16 which engages the pin 9 co-acts with the safety retention member 18 which is preferably pivoted.

In FIG. 2 the coupler 2 is shown with openings 3*a* and 7*a* to provide the pivots 3 and 7 respectively referred to with respect to FIG. 1. Shown connected to the first component 11 are connectors 12 of the hydraulic ram arrangement 13 to be connected by a pin (not shown) to the openings 14 of the end of the slide.

Shown also is the retention member 18 to be pivoted at 19 reliant on the openings 20 which receive a pin therethrough for that purpose.

FIG. 9A shows the ram pinned at its opening 21 to the opening 22 of the first component.

FIG. 9A shows the slide 15 having been moved to a condition beyond that it needs to assume to have held docked a second pin of an implement. At such condition the safety retention member 18 has been pivoted upwardly about its pivot axis 19. The slide 15 includes a projection 23 which has interfered with the part 24 of the retention member 18 thus to uplift it from its non-retaining condition as shown in FIG. 9A relative to the first dock 16.

FIG. 9B shows, with the arrow, the slide 15 under the action of the hydraulic ram moving to the right thus allowing gravity to take the safety retention member 18 down to a condition where it can act as a safety retention member of any pin received by then in the dock 16 (none being shown in FIG. 9B). In such a condition the member 23 of the slide bears over part 25 to prevent the easy uplifting of the component 18 about its pivot axis i.e. its acts as a safety retainer. Similarly when even moved further to the right as shown in FIG. 9C.

Figure 1:
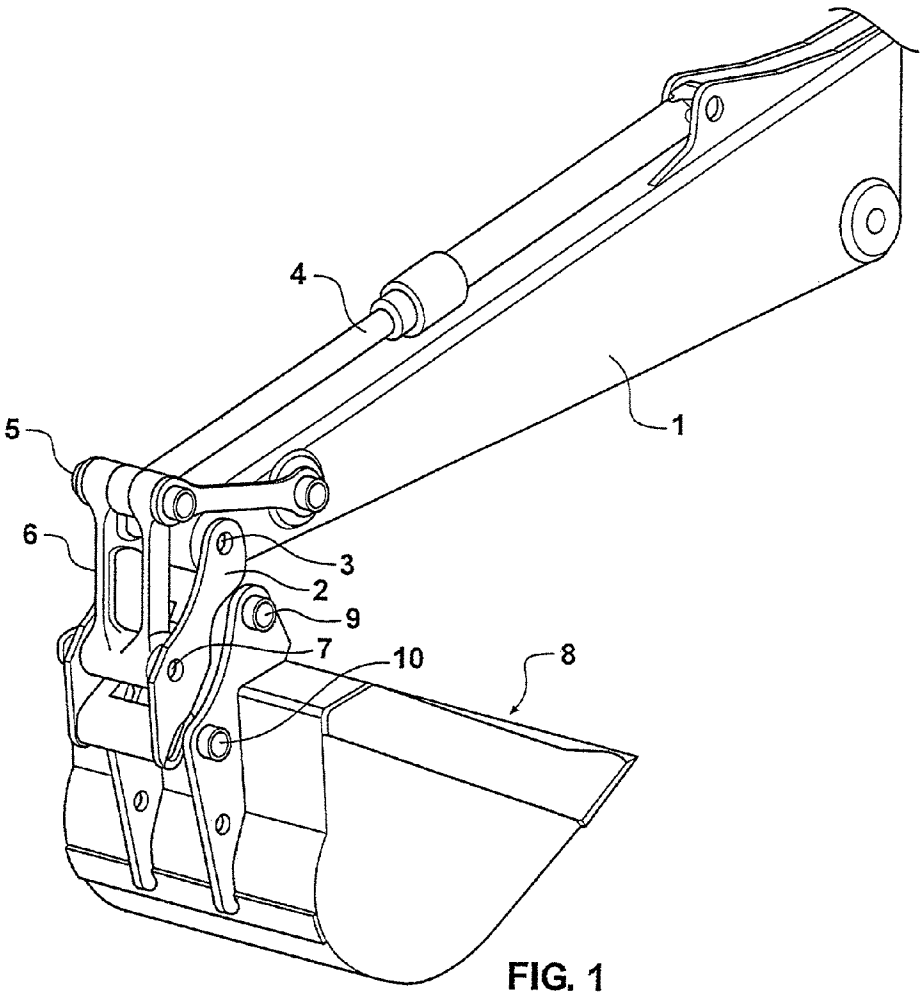
Figure 2:
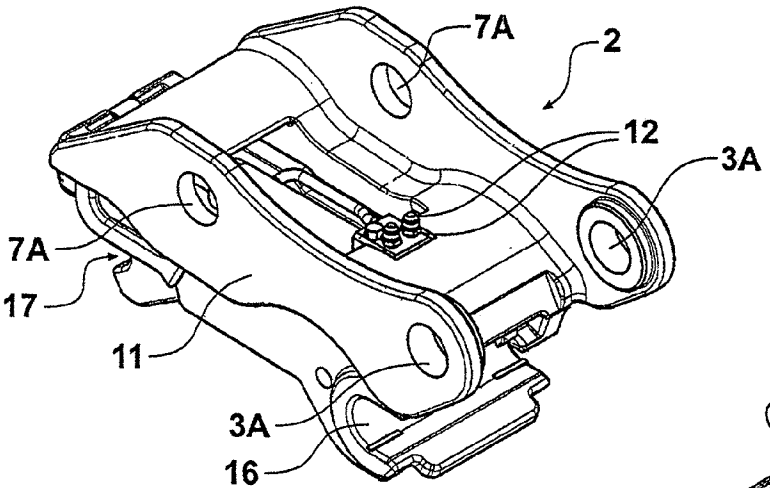
Figure 3:
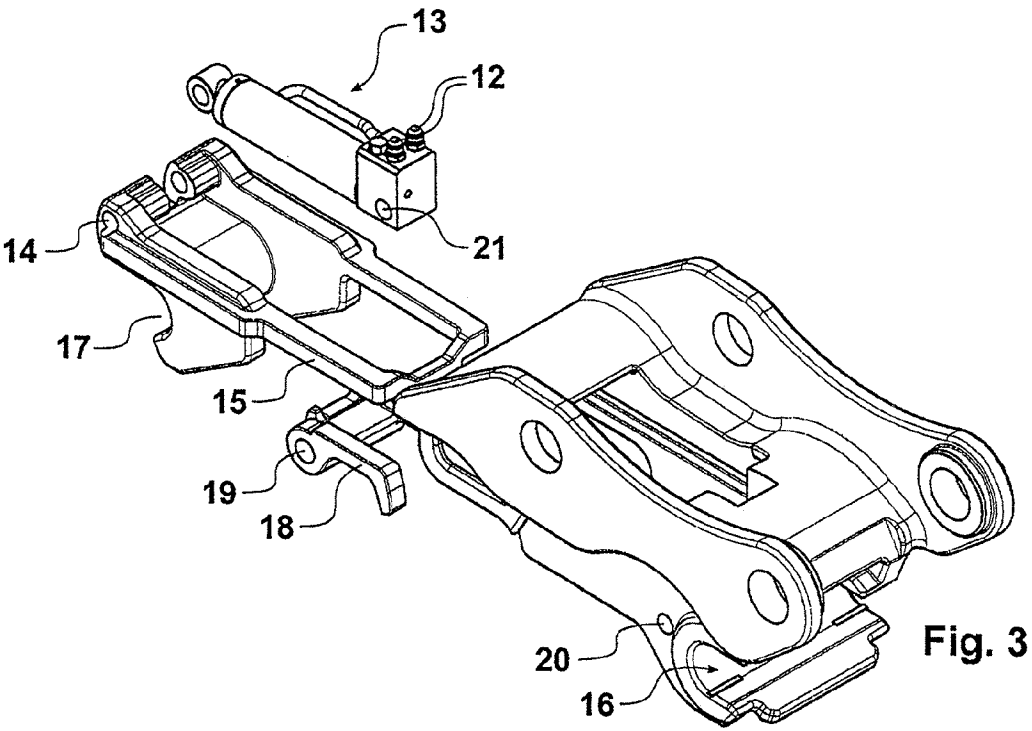
Figure 4:
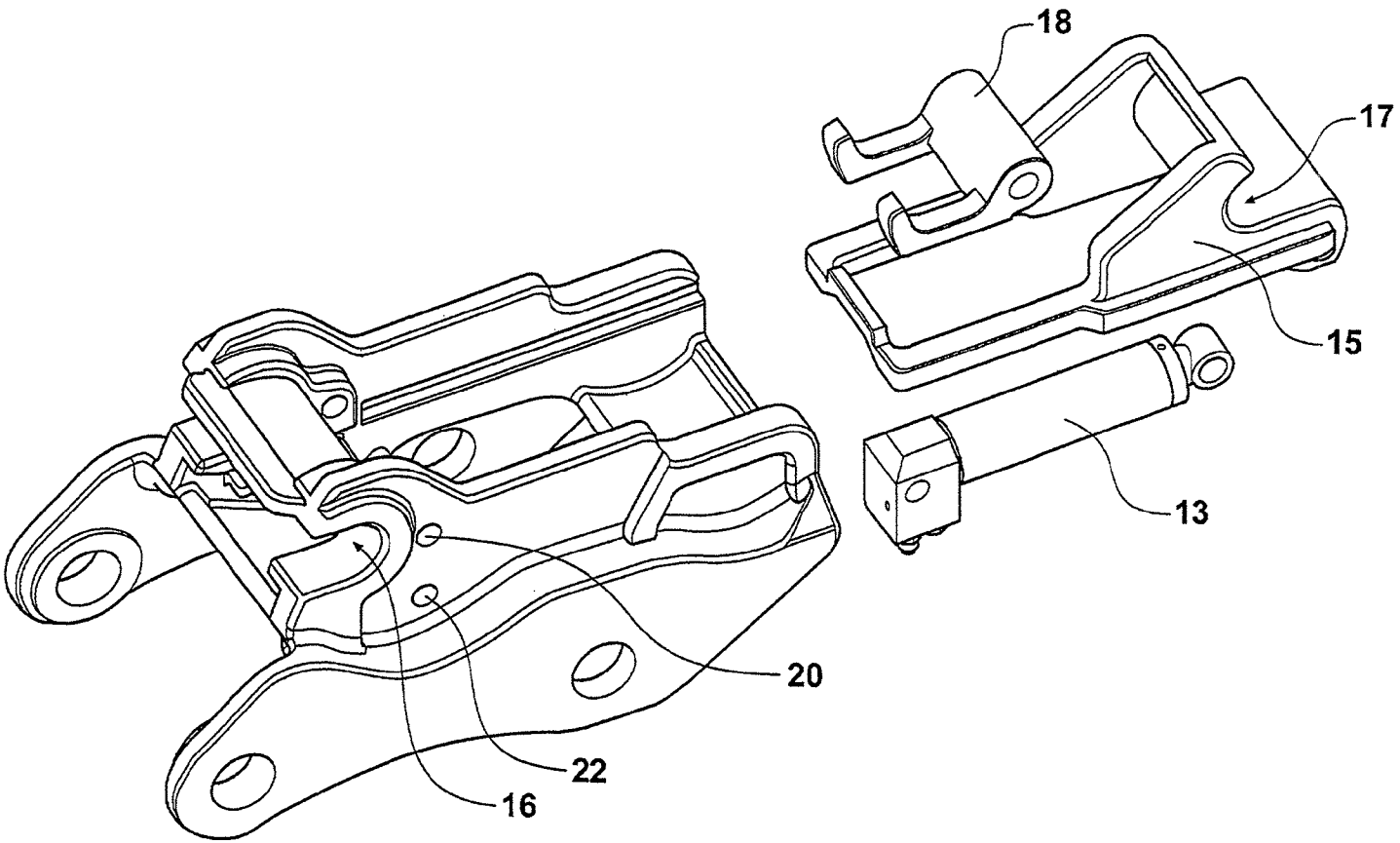
Figure 6:
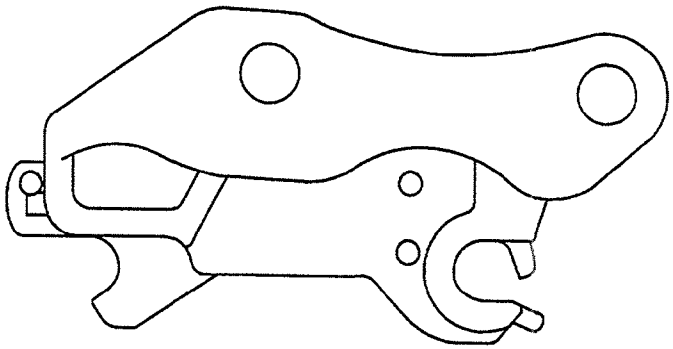
Figure 8:
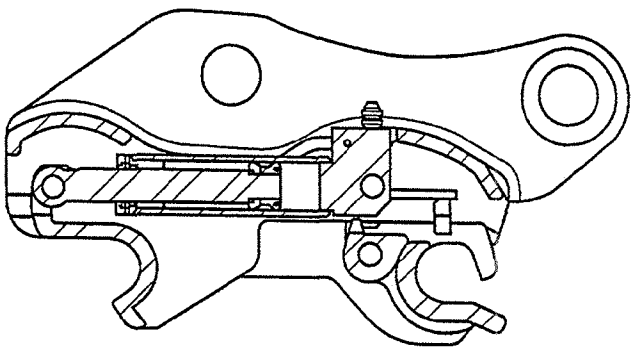
Figure 5:
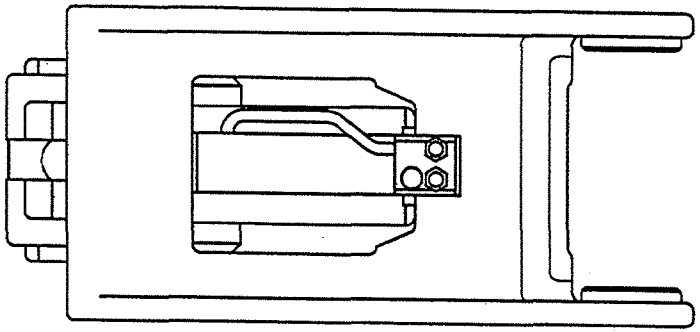
Figure 7:
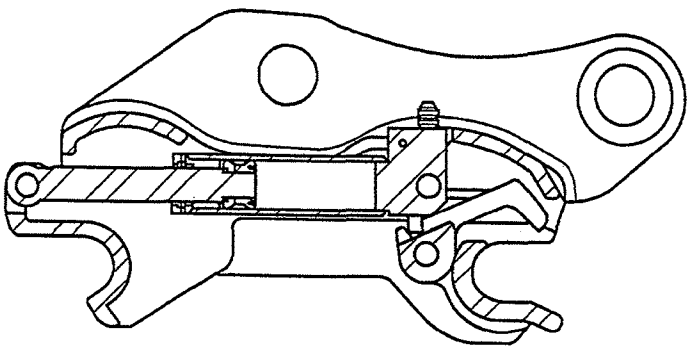
Figure 9A:
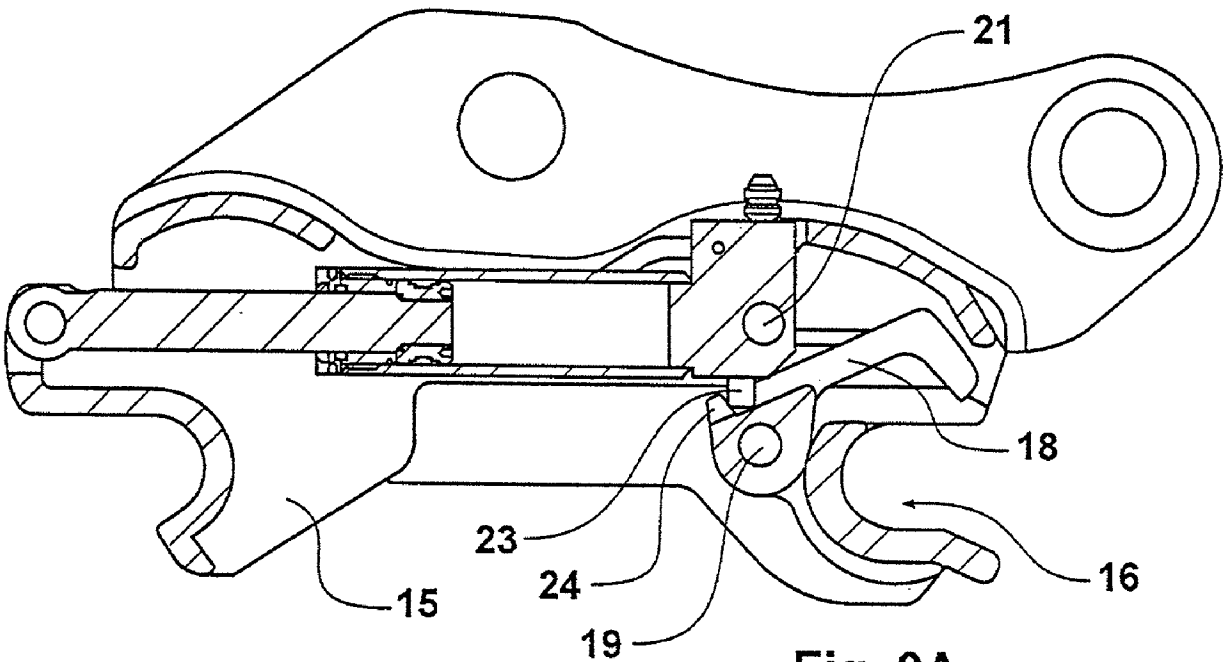
FIG. 9C shows the slide 15 having been moved to its furtherest condition to the right whereupon it is then possible to position, by reconfiguring (the disposition of the coupler by manipulation of the hydraulics of the boom) the second pin of an implement to be received by the second dock.
FIG. 9D shows movement to a condition which then engages against the pin of the implement so that the dock 17 then has received the second pin from the opposite direction to its first dock 16.
Figure 9B:
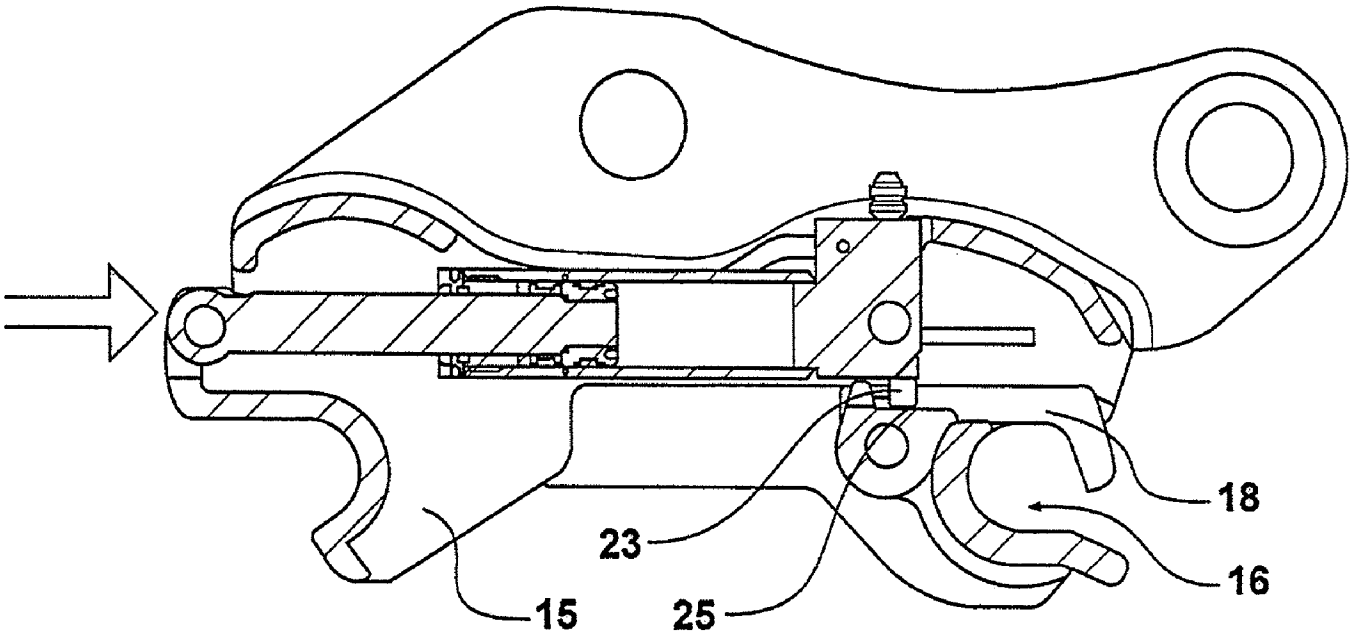
Figure 9C:
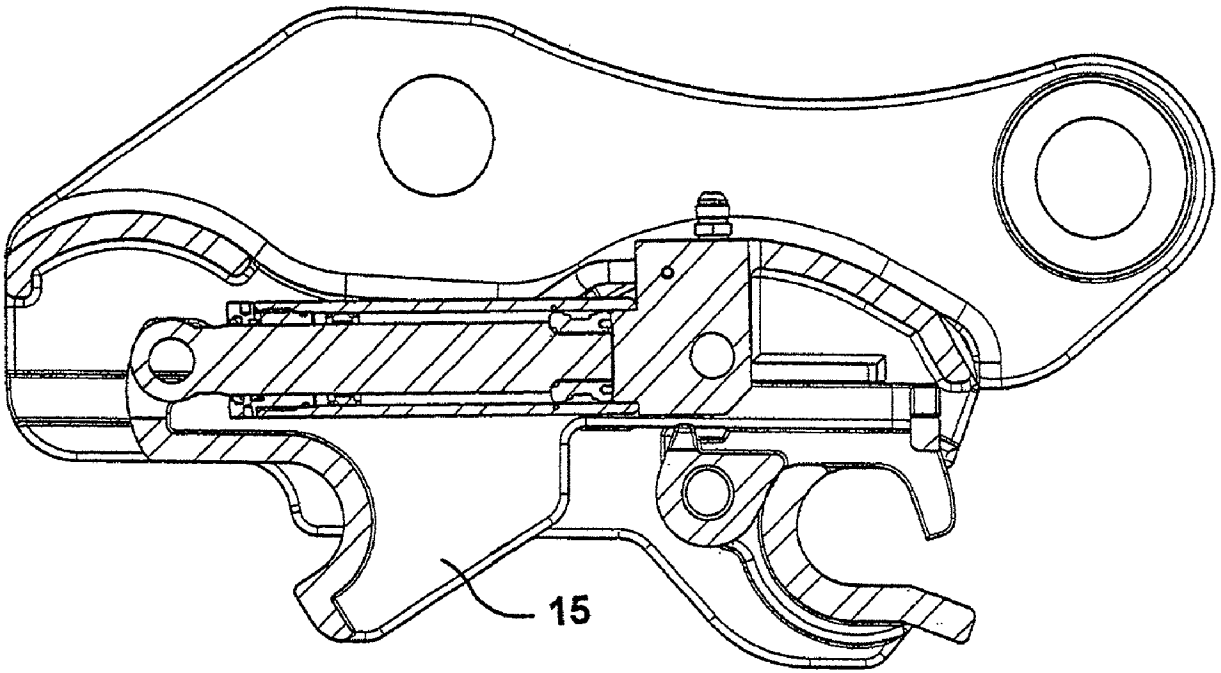
Figure 9D:
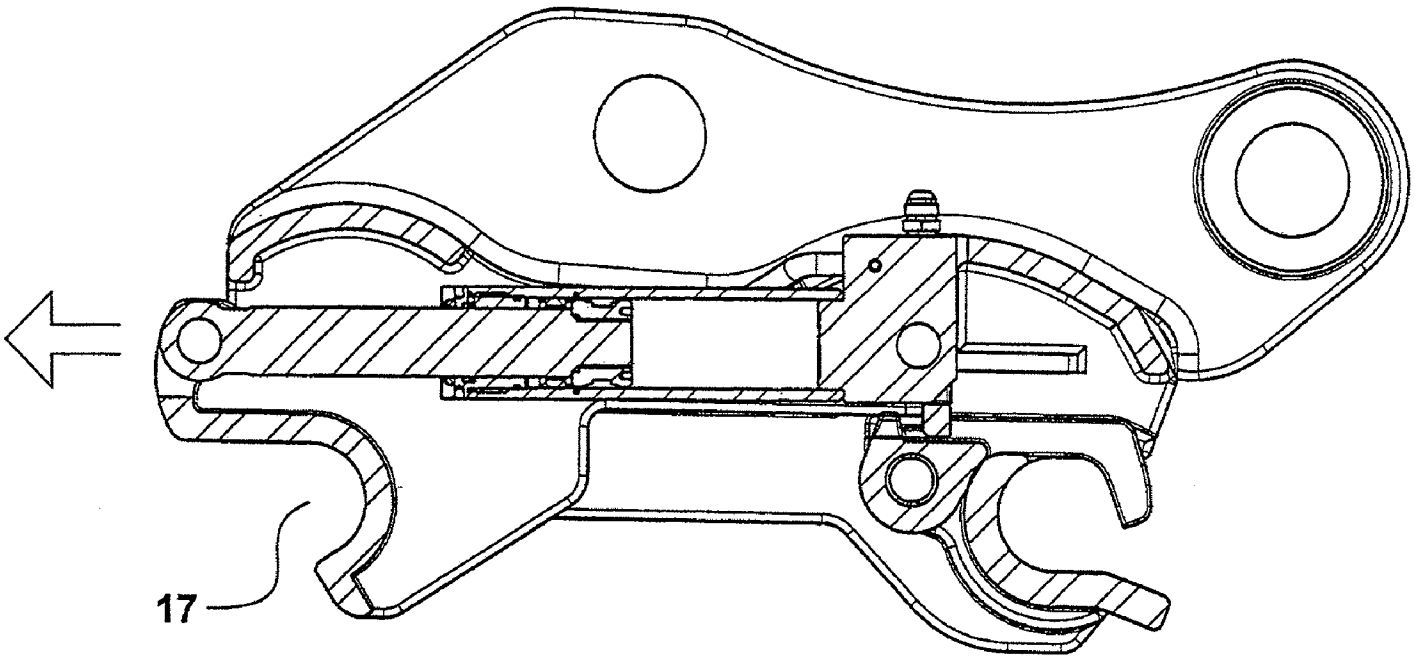
Figure 10:
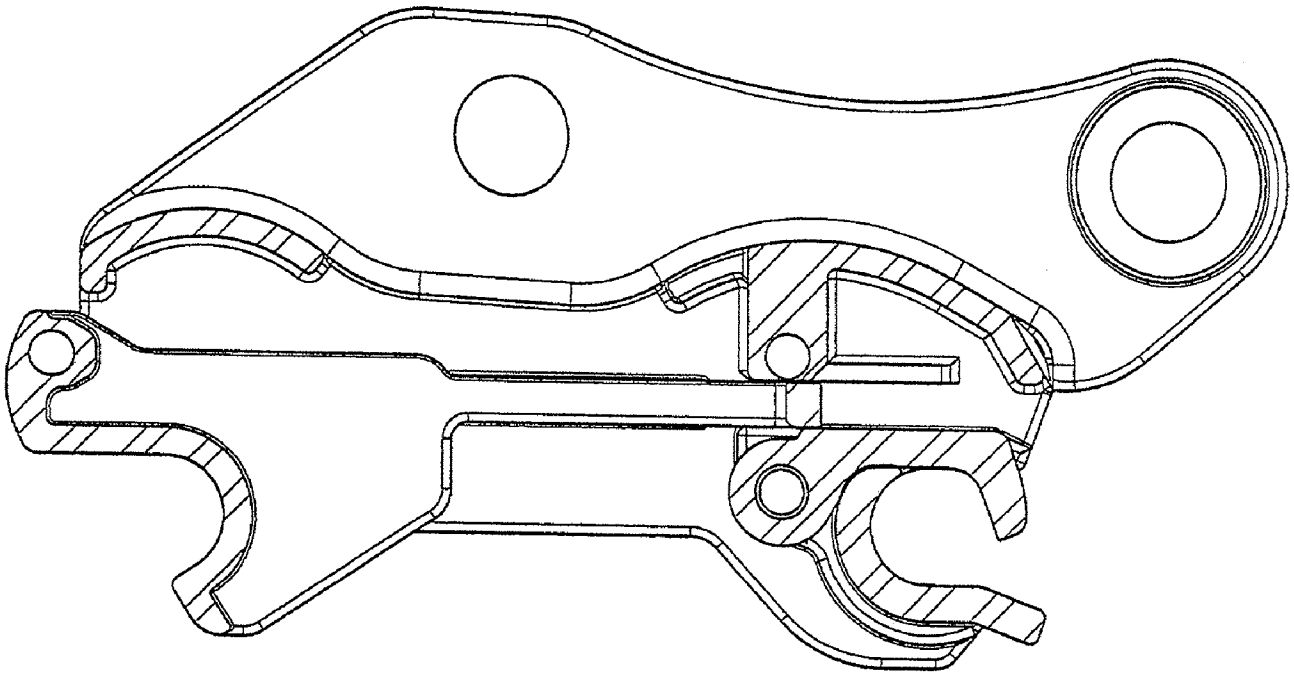
Figure 11:
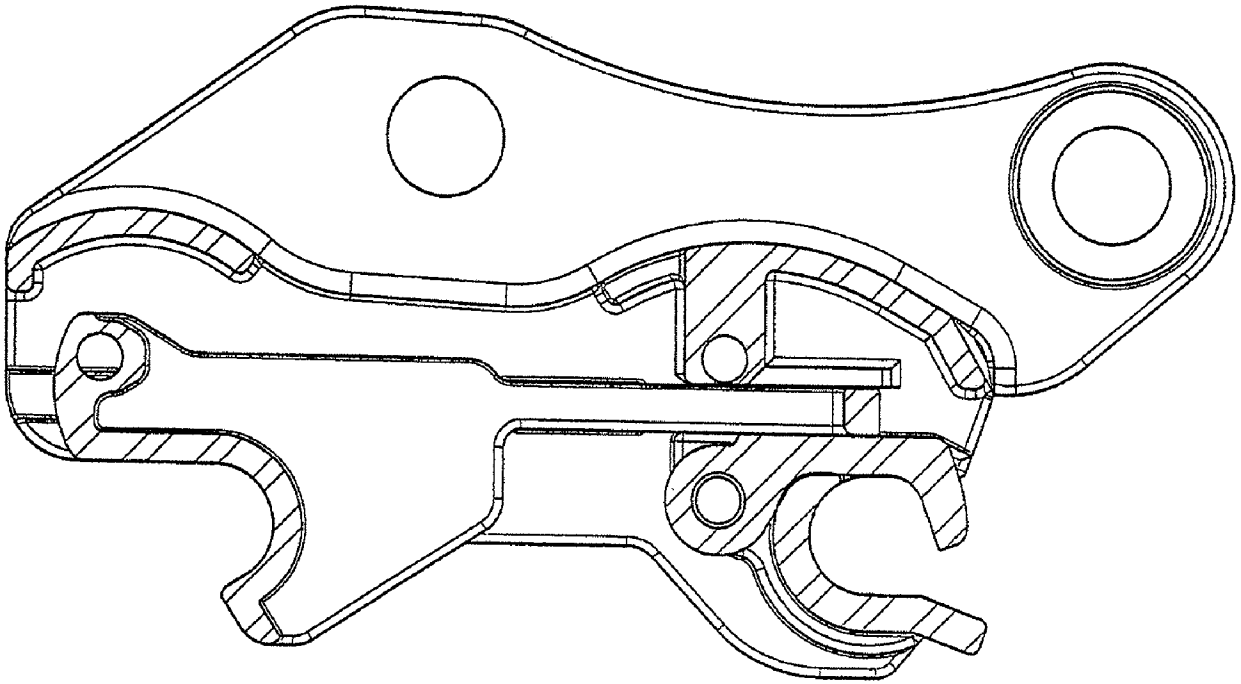

De-hitching is simply a reverse of the sequence shown in FIGS. 9A to 9D, i.e. the second pin is de-hitched by moving the slide 15 from the position shown in FIG. 9D to its furtherest condition to the right as shown in FIG. 9C, and then the first pin is de-hitched by moving the slide 15 back past the position shown in FIG. 9B and to its furtherest condition to the left as shown in FIG. 9A.

It is believed that a coupler assembly in accordance with the present invention, with its fail safe provision on at least one of the two pins as a result of the action of the safety retention member, and the easy deployment and removal of the safety retention member, allows for quick hitching and de-hitching of a suitably positioned implement.

Figure 12:
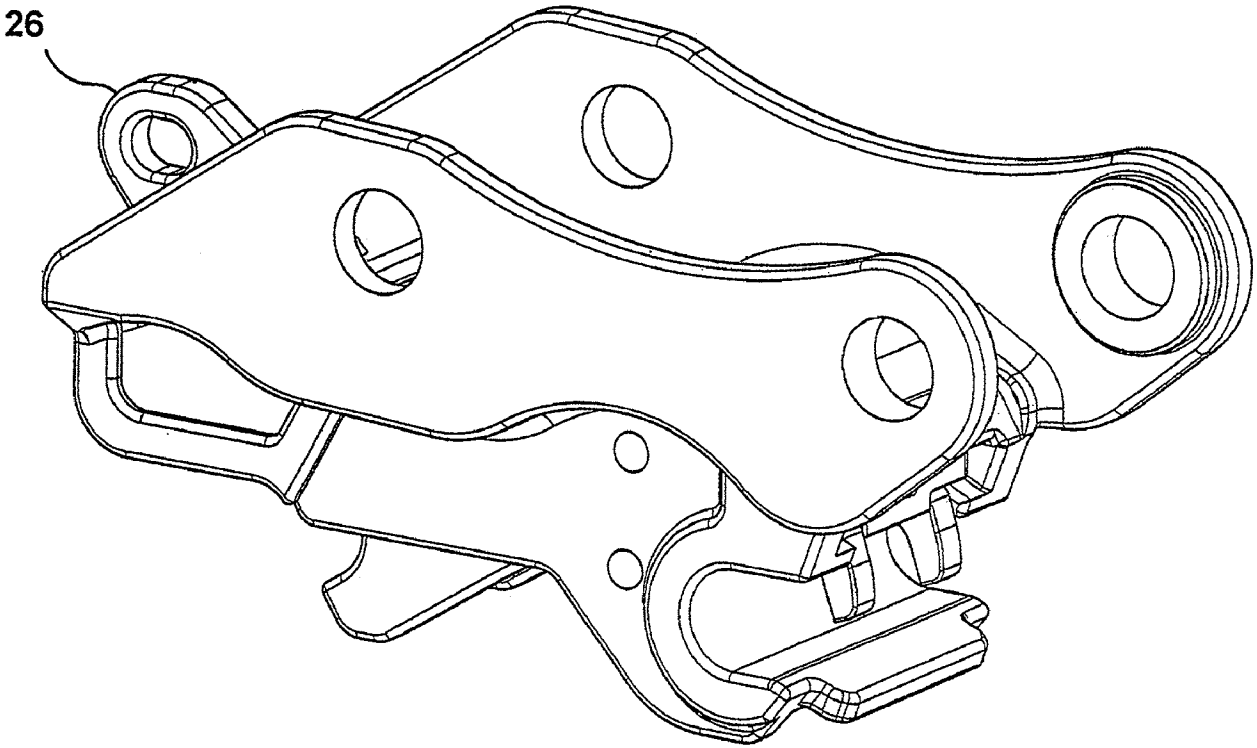
Figure 13:
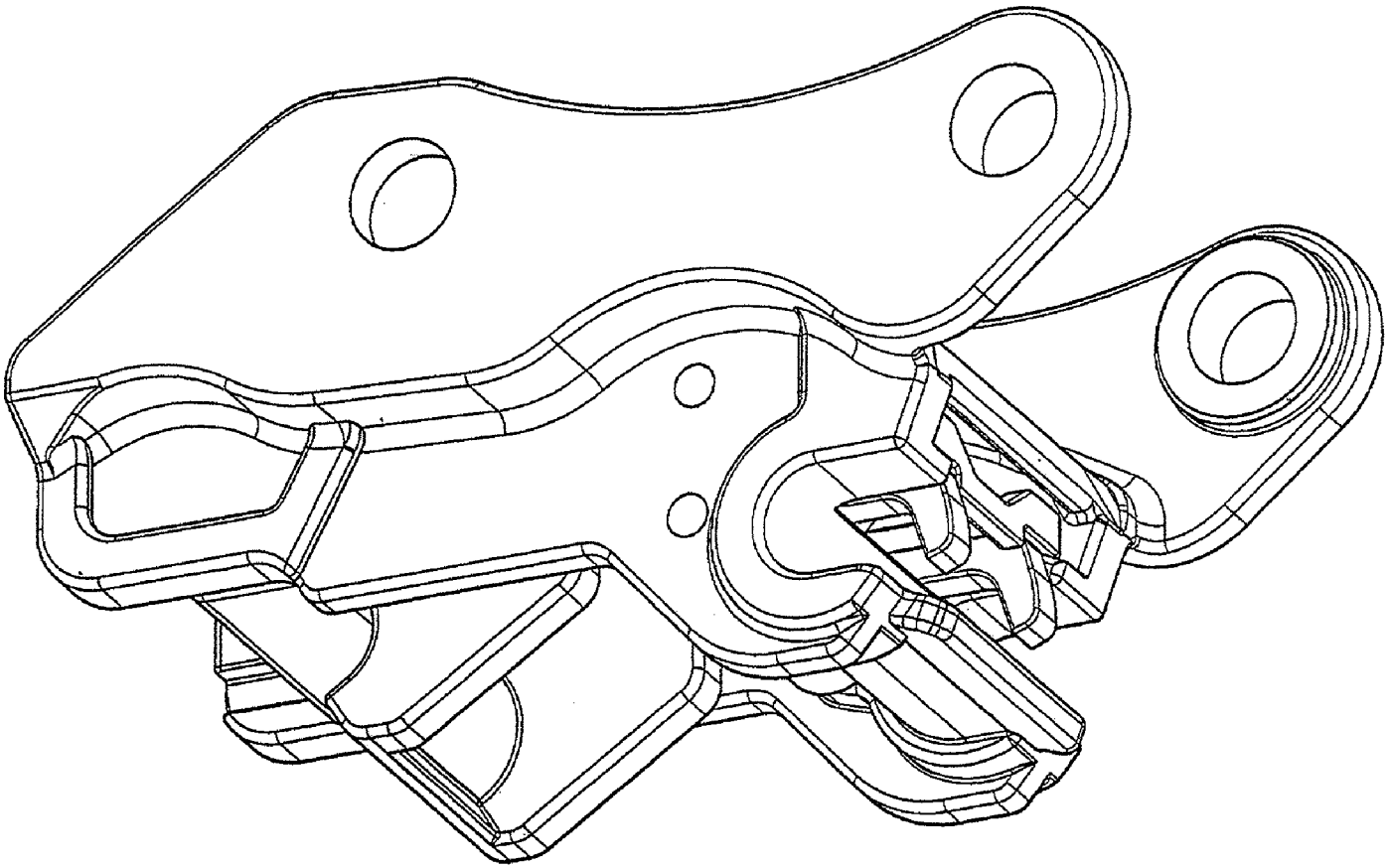
Figure 14:
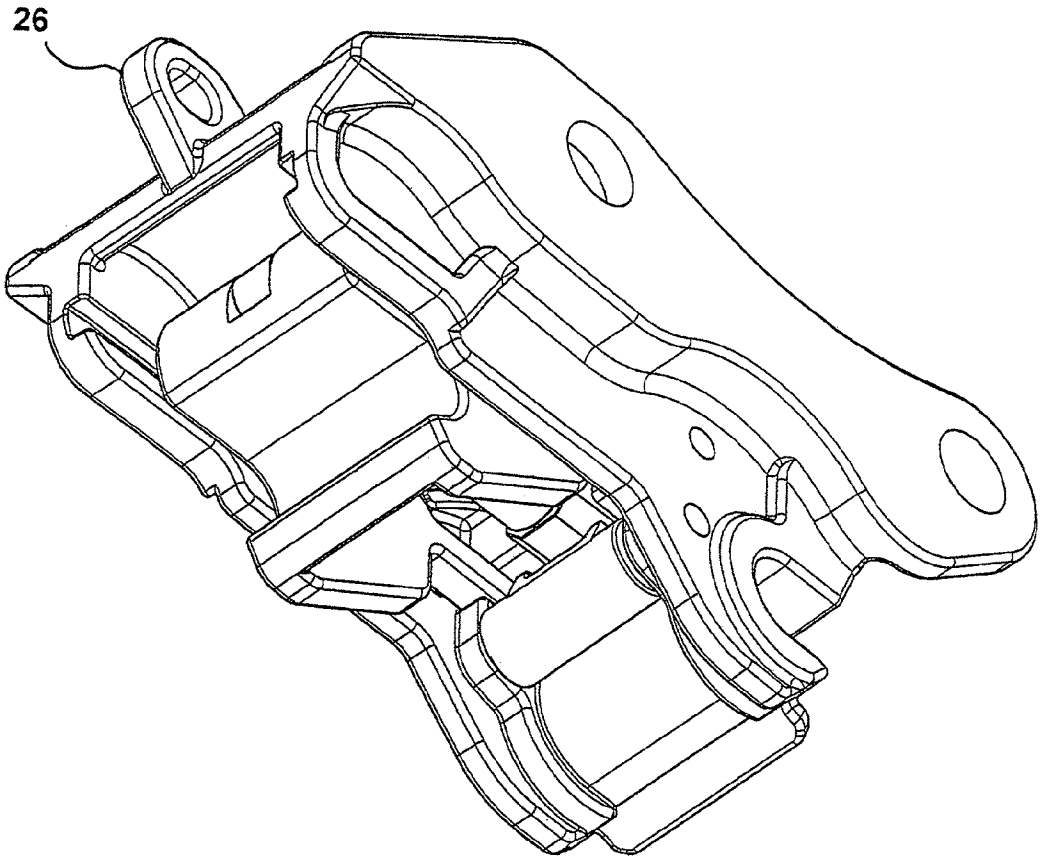
Figure 15:
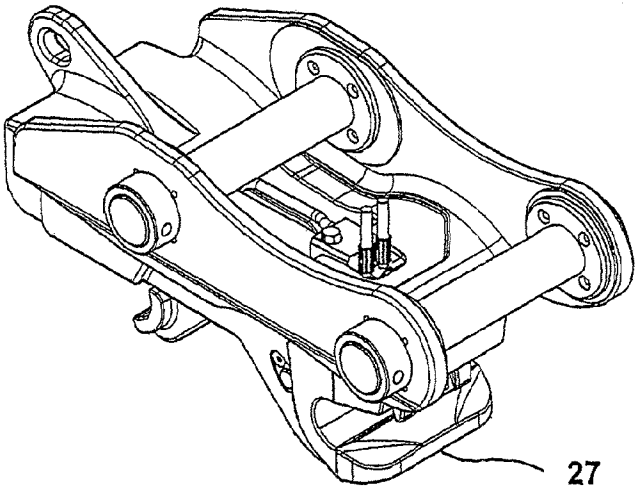
Figure 18:
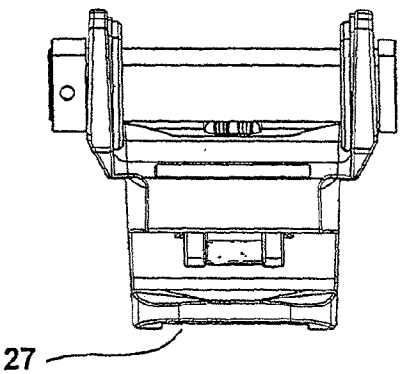
Figure 16:
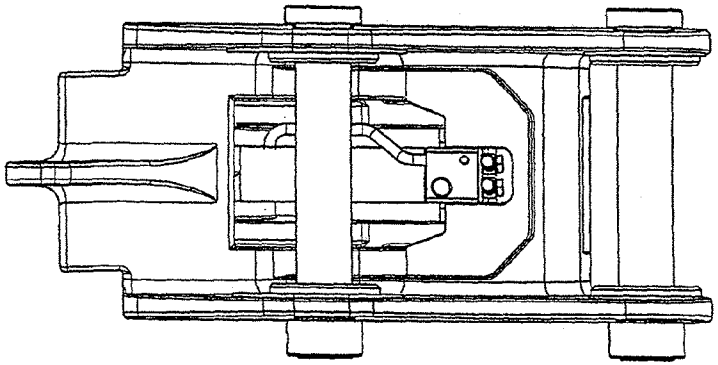
Figure 17:
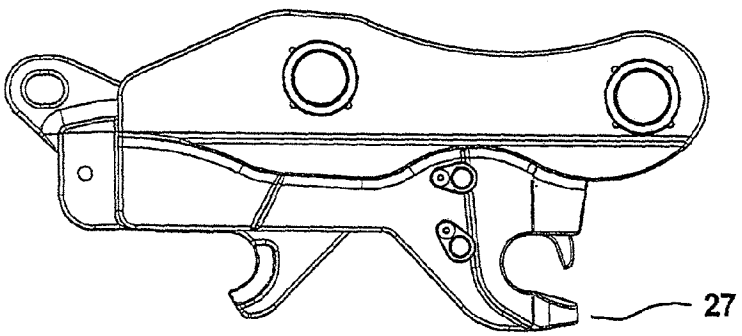

FIGS. 12 through 14 show the coupler as previously described from a number of views. Its disclosure should be considered as an addition to that shown by the earlier drawings. Where the coupler of FIGS. 12 through 14 differs those previously shown is in the provision of a lifting loop 26. This may be appropriate for some sizes of coupler in a range of sizes.

Please note:

1. Low profile compared to existing couplers through its compact design.

2. Safety Hook activated by Clamp Hook movement. No need for operator to get out of digger and place manual safety pin.

3. The 13.5 Tonne Hydraulic Coupler shown can clamp on a variety of different bucket pin centres from 431 down to 355. This allows buckets from different diggers of 12 to 14 tonnes to be able to be used on the one coupler.

4. The cylinder has a check valve incorporated into it plus both hydraulic hoses connect to cylinder base.

The embodiment of FIGS. 15 through 18 is very similar to that of the embodiment already described. The major difference is in respect of the tongue region 27 which is both extended to assist in manipulation of an implement prior to its being locked on. The tongue 27 also includes a radius profile as shown again for assisting in such pre-locking manipulation of the disposition of an implement to be engaged thereby or after disengagement therefrom.

Also shown in the embodiment of FIGS. 15 to 18 is a different connection arrangement for the hydraulics of the unit.

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art.

What we claim is:

1. A coupler assembly for coupling implements having a first pin and a second pin, to a vehicle, the coupler assembly comprising (a) a first component connectable to the vehicle, the first component including a first dock for receiving the first pin, (b) a second component supported by the first component and the second component being movable through a range of travel relative to the first component, and including, or forming a part of, a second dock for receiving the second pin, and (c) an actuator for selectively moving the second component relative to the first component;

the actuator selectively moving the second component to and between a first position at one extent of the second component's range of travel, a second position at an opposite end of the second component's range of travel, and a third position in which the second pin is held within the second dock and which is located between the first position and the second position such that (i) the first pin being only received into the first dock when the second component is at or adjacent the first position and the second pin is not received within the second dock, and (ii) when the first pin is received within the first dock the second being only received in the second dock by first moving the second component in a first direction toward the second position and then in a second and opposite direction back toward the third position.

2. The coupler assembly as claimed in claim 1, wherein the first pin only exits the first dock when the second component is at or adjacent the first position.

3. The coupler assembly as claimed in claim 1, wherein the second component positions a retainer which retains the first pin within the first dock when the second component is at or adjacent the second position, and when the second component is at or adjacent the third position.

4. The coupler assembly as claimed in claim 1, wherein the first direction is a direction substantially toward the first dock.

5. The coupler assembly as claimed in claim 3, wherein only a single actuator selectively positions the second component in a range of locations, and also selectively positions the retainer by selectively positioning the second component.

6. The coupler assembly as claimed in claim 1, wherein the second component is slidable relative to the first component.

7. The coupler assembly as claimed in claim 1, wherein the second component includes a substantially planar slide portion from which a structure forming the second dock extends.

8. The coupler assembly as claimed in claim 3, wherein the retainer is a latching member which is moved by the second component between a retracted position in which the first pin moves into or out of the first dock, and an extended position in which the first pin does not move into or out of the first dock.

9. The coupler assembly as claimed in claim 8, wherein the second component includes a projection which moves and/or positions the latching member.

10. The coupler assembly as claimed in claim 1, wherein the first and second docks open to opposite directions.

11. The coupler assembly as claimed in claim 1, wherein the coupler assembly is connectable to a movable arm of the vehicle.

12. The coupler assembly as claimed in claim 4, wherein the second component includes a substantially planar slide portion from which a structure forming the second dock extends.

13. A coupler assembly for coupling implements having a first pin and a second pin, to a vehicle, the coupler assembly comprising (a) a first component connectable to the vehicle, the first component including a first dock at or adjacent a forward end for receiving the first pin, (b) a second component supported by the first component and the second component being movable through a range of travel relative to the first component, and including, or forming part of, a second dock for receiving the second pin, and (c) an actuator for selectively moving the second component relative to the first component;

the actuator selectively moving the second component to and between a forward-most position at one extent of the second component's range of travel, an aft-most position at an opposite end of the second component's range of travel, and a third position in which the second pin is held within the second dock and which is located between the forward-most position and the aft-most position such that (i) when the first pin is received in the first dock, the second pin only being received within the second dock by moving the second component from a location at or adjacent the forward-most position and toward the third position; and (ii) when both the first and second pins of the implement are received in the first and second docks respectively, the implement being only un-coupled from the coupler assembly by first moving the second component toward the forward-most position to allow the second pin to be released and then moving the second component back to, or adjacent to, the aft-most position to allow the first pin to be released.

14. The coupler assembly as claimed in claim 13, wherein the second component positions a retainer which retains the first pin within the first dock when the second component is at and between the second component's forward-most position and the second component's third position.

15. The coupler assembly as claimed in claim 14, wherein only a single actuator selectively positions the second component in a range of locations, and also selectively positions the retainer by selectively positioning the second component.

16. The coupler assembly as claimed in claim 13, wherein the second component is slidable relative to the first component.

17. The coupler assembly as claimed in claim 13, wherein the second component includes a substantially planar slide portion from which a structure forming the second dock extends.

18. The coupler assembly as claimed in claim 14, wherein the retainer is a latching member which is moved by the second component between a retracted position in which the first pin moves out of the first dock, and an extended position in which the first pin does not move out of the first dock.

19. The coupler assembly as claimed in claim 18, wherein the second component includes a projection which moves and/or positions the latching member.

20. The coupler assembly as claimed in claim 13, wherein the first and second docks open to opposite directions.

21. The coupler assembly as claimed in claim 13, wherein the coupler assembly is connectable to a movable arm of the vehicle.

22. A coupler assembly for coupling implements having a first pin and a second pin, to a vehicle, the coupler assembly comprising (a) a first component connectable to the vehicle, the first component including a first dock at or adjacent a forward end for receiving the first pin, (b) a second component supported by the first component and the second component being movable through a range of travel relative to the first component, and including, or forming part of, a second dock for receiving the second pin, and (c) an actuator for selectively moving the second component relative to the first component;

the actuator selectively moving the second component to and between a forward-most position at one extent of the second component's range of travel, an aft-most position at an opposite end of the second component's range of travel, and a third position in which the second pin is held within the second dock and which is located between the forward-most position and the aft-most position; and a latching member movable between a retracted position in which the latching member prevents the escape of the first pin from the first dock, and an extended position in which the latching member allows the escape of the first pin from the first dock.

23. The coupler assembly as claimed in claim 22, wherein the second member holds the latching member in the extended position when the second member is at and between the second member's forward-most position and the second member's third position.

24. The coupler assembly as claimed in claim 22, wherein the second component moves the latching member to the retracted position when the second component is moved to the second component's aft most-position.

25. The coupler assembly as claimed in claim 22, wherein the second member holds the latching member in the extended position when the second member is at and between the second member's forward-most position and the second member's third position, and the second component moves the latching member to the retracted position when the second component is moved to the second component's aft most-position.

26. The coupler assembly as claimed in claim 22, wherein only a single actuator selectively positions the second component in a range of locations, and also selectively positions a retainer by selectively positioning the second component.

27. The coupler assembly as claimed in claim 22, wherein the second component is slidable relative to the first component.

28. The coupler assembly as claimed in claim 22, wherein the second component includes a projection which moves and/or positions the latching member.

29. The coupler assembly as claimed in claim 22, wherein the first and second docks open to opposite directions.

30. The coupler assembly as claimed in claim 22, wherein the coupler assembly is connectable to a movable arm of the vehicle.

* * * * *